US005372174A

United States Patent [19]

Wilke

[11] Patent Number: 5,372,174

[45] Date of Patent: Dec. 13, 1994

[54] SPLASH GUARD USED IN CLEANING TOOLS AND OTHER ITEMS

[76] Inventor: Harland E. Wilke, 23200 Mora Glen Dr., Los Altos, Calif. 94024

[21] Appl. No.: 53,645

[22] Filed: Apr. 27, 1993

[51] Int. Cl.[5] ..... A47G 5/00

[52] U.S. Cl. ..... 160/135

[58] Field of Search ..... 160/135, 351, 352, 229.1, 160/233, 130, 218, 220

[56] References Cited

U.S. PATENT DOCUMENTS

| | | | |
|---|---|---|---|
| 2,319,664 | 5/1943 | Davis et al. | 160/351 |
| 2,499,859 | 3/1950 | Halter | 160/351 X |
| 2,532,378 | 12/1950 | Starnes | 160/135 |
| 2,582,373 | 1/1952 | Cordrey | 160/352 X |
| 2,591,786 | 4/1952 | Cronheim | 160/135 |
| 2,823,744 | 2/1958 | Garris | 160/135 |
| 3,538,976 | 11/1970 | Gilbert et al. | 160/135 X |

*Primary Examiner*—David M. Purol

*Attorney, Agent, or Firm*—Julian Caplan

[57] ABSTRACT

Tools used by masons, painters, plasterers, wallboard tapers and many others are usually cleaned at the end of the day by hosing them off. Water may splash back, wetting the shoes and pants of the workman. Also water may accumulate on the ground or paved surface where cleaning is being carried out, causing the soles of shoes or boots to become soaked. The present invention comprises a hinged member comprising a base on which the workman stands and a vertical leaf in front of the workman to intercept splashes. Side wings may be hinged to the vertical leaf.

4 Claims, 1 Drawing Sheet

SPLASH GUARD USED IN CLEANING TOOLS AND OTHER ITEMS

BACKGROUND OF THE INVENTION

1. Field of the Invention

This invention relates to a new and improved splash guard used in cleaning workmen's tools with a hose to prevent water splashing back on the shoes or pant legs of the workmen and also to prevent water from accumulating on the ground to wet the soles of the workmen's shoes or boots.

2. Description of Related Art

Many devices have been used in the past to prevent splashing, however, the present invention differs in that it comprises two members hinged together, one being a base on which the workman stands and the other being a shield which projects up from the base at about a 90°.

SUMMARY OF THE INVENTION

The present invention employs a base 12 on which a workman stands, the base preferably being elevated above the ground so that water accumulating on the ground does not wet the soles of the workman's footwear. Hinged to the base is a shield which assumes an approximately vertical position located between the workman and the tools being hosed to prevent water splashing back on the shoes or pant legs of the user. A limiting device prevents the shield from pivoting forward away from the base. Such a limiting device may comprise a member shaped as a right angle in side elevation having one flange attached to the bottom edge of the shield and the other flange so positioned that it fits under the edge of the base and thereby prevents the shield from pivoting more than 90° forwardly from the base.

As an alternate, side wings may be hinged to the shield to prevent water from splashing behind the shield when the hose is directed outwardly to either side of the base.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Figure 1:
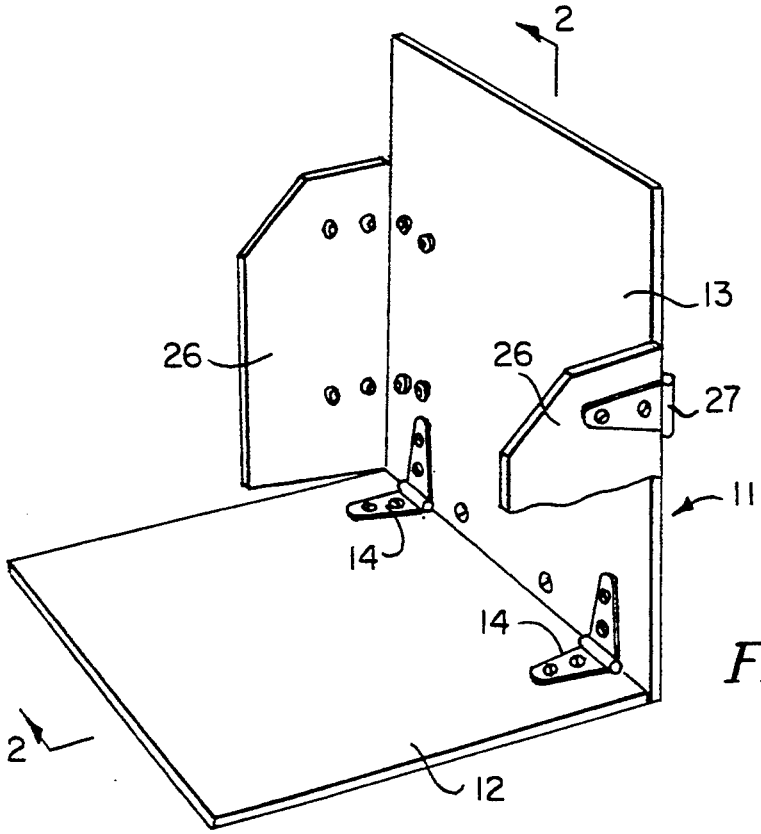
FIG. 1 is a perspective view of the device in open position, one of the wings being partly broken away to reveal structure which would otherwise be obscured.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Splash guard 11 comprises a base 12 and a shield 13 which is in vertical position when the device is in use, the members being hinged together by hinges 14. It will be understood that the form of hinge used is subject to wide variation. Optionally, the base 12 may be elevated above the ground 17 by legs 16 affixed to the bottom of the base 12.

Figure 2:
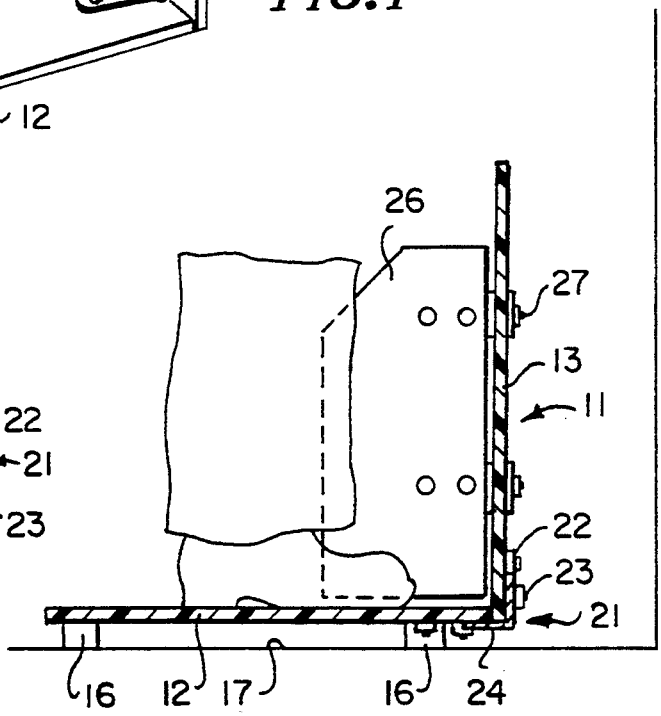
FIG. 2 is a vertical sectional view taken substantially along the line 2—2 of FIG. 1.

With the type of hinge 14 shown in FIG. 1, it will be understood that the shield 13 instead of being vertical could pivot around to approximately a horizontal position. To prevent such pivoting to occur, a hinge limiter 21 is used. Such limiter 21 viewed in end elevation is shaped as a right angle. Flange 22 is attached near the bottom edge of the outside of shields 13 by bolts 23. The flange 24 at right angles to flange 22 is so located that, when the shield 13 is erect as shown in FIG. 2, the flange 24 fits under the forward edge of base 12. Thus the shield 13 is held approximately in vertical position. In use, the device is shown in FIGS. 1 and 2. However, between uses the shield 13 may be folded downward parallel to base 12 for transportation and storage.

Figure 4:
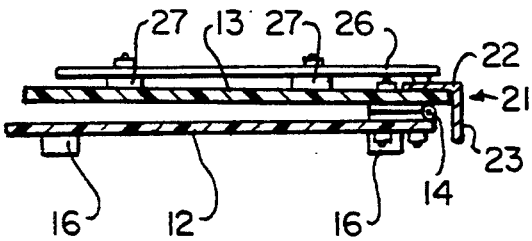
FIG. 4 is a sectional view taken substantially along the line 4—4 of FIG. 3.
Figure 3:
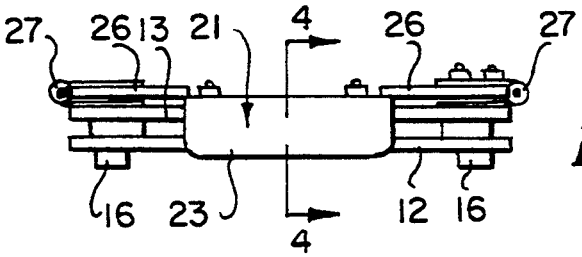
FIG. 3 is a view from the front showing the guard folded for transportation and storage.

As an optional but desirable feature of the invention, side wings 26 may be hinged to the side edges of shield 13 by means of hinges 27. The wings 26 prevent water from splashing back if the hose is directed outwardly of the shield 13. Between uses, the wings 26 may be folded out outside shield 13 as shown in FIGS. 3 and 4.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

I claim:

1. A splash guard comprising a horizontal base having a forward edge, a shield having a lower edge, hinge means hinging said lower edge to said forward edge for pivotal movement of said shield between an erect vertical position and a folded horizontal position overlying said base, said shield having first and second side edges and which further comprises first and second vertical wings, vertical second hinge means hinging said first wing to said first side edge and vertical third hinge means hinging said second wing to said second side edge.

2. A splash guard according to claim 1 which further comprises limiting means on one of said base and shield for limiting maximum pivotal movement in the erect vertical position to approximately 90° relative to said base.

3. A splash guard according to claim 2 in which said limiting means comprises a member having first and second flanges disposed at approximately 90° relative to each other, said first flange being attached to said shield adjacent said lower edge, said second flange fitting under said forward edge of said base.

4. A splash guard according to claim 1 which further comprises means supporting said base above the ground.

* * * * *